US006634157B2

(12) United States Patent
Anderson et al.

(10) Patent No.: US 6,634,157 B2
(45) Date of Patent: Oct. 21, 2003

(54) APPARATUS FOR INERTING GABLE TOP CARTON HEAD SPACE

(75) Inventors: Paul Anderson, Addison, IL (US); Ronald Swank, Crystal Lake, IL (US)

(73) Assignee: Tetra Laval Holdings & Finance, SA, Pully (CH)

( * ) Notice: Subject to any disclaimer, the term of this patent is extended or adjusted under 35 U.S.C. 154(b) by 91 days.

(21) Appl. No.: 09/742,504

(22) Filed: Dec. 20, 2000

(65) Prior Publication Data

US 2002/0073659 A1 Jun. 20, 2002

(51) Int. Cl.[7] ..... B65B 31/06
(52) U.S. Cl. ..... 53/510; 53/565
(58) Field of Search ..... 53/432, 433, 456, 53/458, 467, 477, 484, 510, 511, 563, 565

(56) References Cited

U.S. PATENT DOCUMENTS

| | | | | |
|---|---|---|---|---|
| 4,869,047 A | | 9/1989 | Nishiguchi et al. | |
| 4,870,801 A | | 10/1989 | Mizandjian et al. | |
| 4,934,127 A | | 6/1990 | Risko et al. | |
| 5,027,588 A | * | 7/1991 | Ikeda et al. | 53/511 |
| 5,085,035 A | | 2/1992 | Marano et al. | |
| 5,201,165 A | | 4/1993 | Marano et al. | |
| 5,213,759 A | | 5/1993 | Castberg et al. | |
| 5,242,701 A | | 9/1993 | Poole | |
| 5,321,930 A | | 6/1994 | Poole | |
| 5,421,512 A | | 6/1995 | Poole | |
| 5,447,016 A | * | 9/1995 | Ueda et al. | 53/510 |
| 5,452,563 A | | 9/1995 | Marano et al. | |
| 5,816,024 A | | 10/1998 | Sanfilippo et al. | |
| 5,911,249 A | | 6/1999 | Sanfilippo et al. | |
| 5,961,000 A | | 10/1999 | Sanfilippo et al. | |
| 6,012,267 A | | 1/2000 | Katsumata | |
| 6,032,438 A | | 3/2000 | Sanfilippo et al. | |
| 6,056,918 A | | 5/2000 | Palaniappan et al. | |
| 6,120,730 A | | 9/2000 | Palaniappan et al. | |

FOREIGN PATENT DOCUMENTS

| | | | | |
|---|---|---|---|---|
| EP | 0 339 491 B2 | | 4/1989 | |
| JP | 2-4618 | * | 1/1990 | 53/373.9 |

* cited by examiner

*Primary Examiner*—Stephen F. Gerrity
(74) *Attorney, Agent, or Firm*—Welsh & Katz, Ltd.

(57) ABSTRACT

A head space inerting system is used in a packaging machine for forming, filling and sealing packages. The inerting system directly introduces an inerting gas into the head space of the formed package subsequent to filling and prior to sealing. The inerting system includes an inerting gas source, an inerting gas heater to heat the inerting gas and an inerting gas nozzle. The inerting gas nozzle is disposed within the form, fill and seal packaging machine to introduce the inerting gas directly into the head space of the packages. The nozzle is further disposed between the top heating station and the sealing station. A method for inerting an atmosphere in the package head space is also disclosed.

7 Claims, 2 Drawing Sheets

APPARATUS FOR INERTING GABLE TOP CARTON HEAD SPACE

BACKGROUND OF THE INVENTION

This invention pertains to an apparatus for providing an inert environment in a gable top carton head space. More particularly, the present invention pertains to a form, fill and seal packaging machine that provides an inert gas in the head space area of a sealed gable top carton and a method for providing the inert environment.

Gable top cartons are in widespread use. In one typical use, these cartons are used for storing liquid food products such as milk, juice and the like. Numerous advances have been made in the manufacture and construction of gable top cartons. These advances include the incorporation of sealable spouts which provide ease of access, i.e., pouring, as well as enhanced reseal capabilities. Consumers have come to expect such enhanced carton designs and demand these increased performance characteristics.

In order to provide increased shelf life and "freshness" of product, form, fill and seal packaging machines presently incorporate various sterilization features. These features generally reduce or eliminate the microbes, such as bacteria, yeast and molds that might otherwise be associated with a packaging operation. It has been found that such sterilization steps can increase the shelf life of product so that fresh product can be provided in markets having less than optimal distribution systems.

It is well-known that although oxygen is a necessary part of our environment, it provides an optimum environment for the growth of microbes such as bacteria. To this end, regardless of the degree to which packages or cartons can be sterilized, the oxygen head space (that is oxygen within the volume of the carton that is not taken up by product), can provide an environment for microbial growth, and otherwise adversely effect the chemical composition of the product.

It has also been observed that oxygen can tend to take away from the flavor of certain products. For example, it has been found that oxygen that is present in the head space of cartons containing certain juices, such as orange juice can adversely effect the flavor of the juice. This is due to the natural oxidizing effect of oxygen. It has also been observed that such oxidizing can adversely effect the nutritional characteristics of juices and the like, again, by the natural deleterious effect that oxygen has on, among others, B vitamins and vitamin C.

Accordingly, there exists a need for an apparatus and method for providing an inert atmosphere or environment within the head space of a carton formed and filled on a form, fill, and seal packaging machine. Desirably, such an apparatus and method provides an environment that reduces or eliminates microbial growth within the package. Most desirably, such an apparatus and method provides an environment that enhances flavor retention and the nutritional characteristics of the packaged product, and maintains the hygienic and sterility levels and standards of the packaged product.

BRIEF SUMMARY OF THE INVENTION

A head space inerting system is for use on a form, fill and seal packaging machine for forming, filling and sealing packages. The head space inerting system includes an inerting gas source, an inerting gas heater and an inerting gas nozzle assembly. The system is configured to directly introduce the inerting gas, preferably nitrogen, into the package head space, above the packaged product.

In a current embodiment, the inerting system is used on a form, fill and seal packaging machine having a having a filling station, a top heating station and a sealing station, and the nozzle assembly is disposed between the top heating station and the sealing station.

The nozzle assembly includes an inlet, a plenum defining a flow space and a dispersion plate. The dispersion plate is formed as a wall of the plenum. The nozzle assembly can include flanges that extend from the plenum in a plane that is spaced from a plane defined by the dispersion plate.

The nozzle is configured for positioning between upstanding fin panels of the package. The dispersion plate is disposed below the tops of the fin panels, and the flanges extend over the fin panel tops. This directs the flow of inerting gas into the package and provides a flow path for air leaving the head space to exit the package. A preferred dispersion plate is formed as a foraminous plate.

The inerting system can include an inerting gas valve assembly and an inerting gas filter/regulator assembly. The valve assembly and filter/regulator assembly are disposed between the inerting gas source an the inerting gas nozzle.

In a preferred system, the inerting gas heater is formed as a heat exchanger supplied by, for example, an electrical resistance heating system heat source or other heat exchange medium such as steam. A current system includes a coil-type heat exchanger having a coil side and a shell side. The inerting gas is directed through the coil side of an electrical resistance or other heating medium is applied to the inner shell.

A form, fill and seal packaging machine having the head space inerting system is contemplated by the present invention and includes a filling station, a top heating station and a sealing station. The nozzle assembly is disposed between the top heating station and the sealing station. A contemplated machine is an extended shelf life (ESL) or aseptic filling machine that requires a sterile environment.

A method for inerting the atmosphere in the head space of a package formed on a form, fill and seal packaging machine includes the steps of forming a package, filling the package with a product, introducing an inerting gas above the product in the package subsequent to filling, and sealing the package with the product and the inerting gas therein.

In a preferred method, the inerting gas is nitrogen. For certain products, the inerting gas can be water vapor ($H_2O$), carbon dioxide ($CO_2$), argon or other gases known to those skilled in the art. Most preferably, the method includes the step of heating the inerting gas prior to introducing it into the head space of the package. In one method, the heating step includes the step of directing the inerting gas through one side of a heat exchanger and providing a heating medium through another side of the heat exchanger. Preferably, the inerting gas is filtered and regulated prior to introducing it into the package head space.

These and other features and advantages of the present invention will be apparent from the following detailed description and the accompanying drawings, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
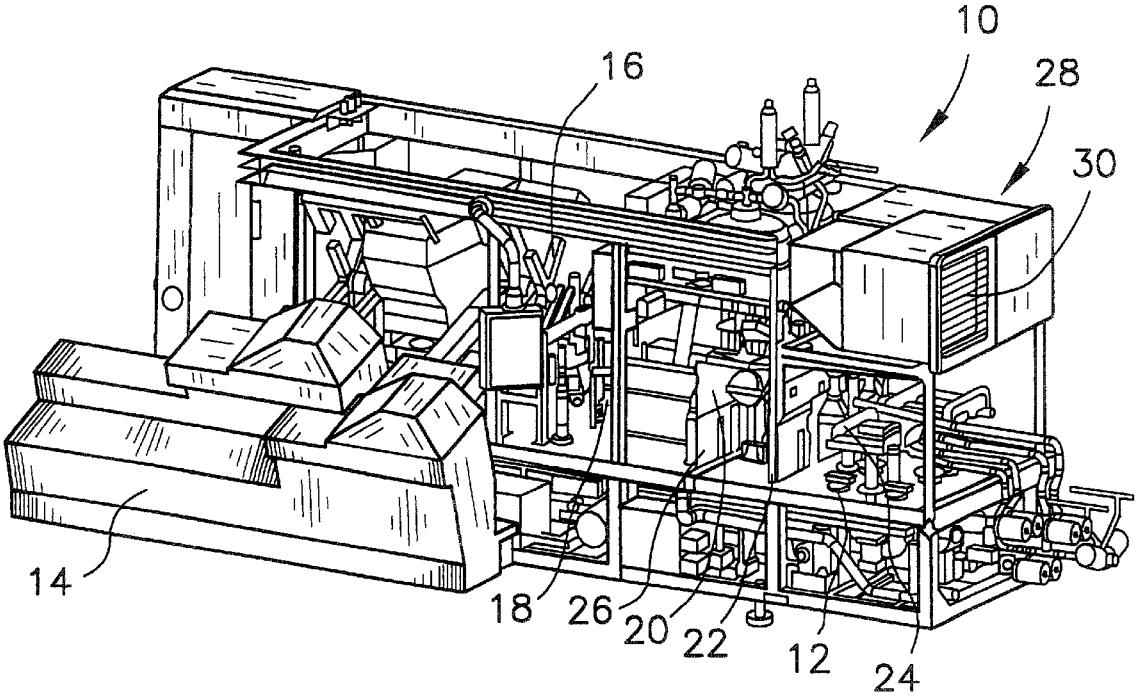
FIG. 1 illustrates a conventional form, fill and seal packaging machine having a head space inerting system in accordance with the principles of the present invention.
Figure 2:
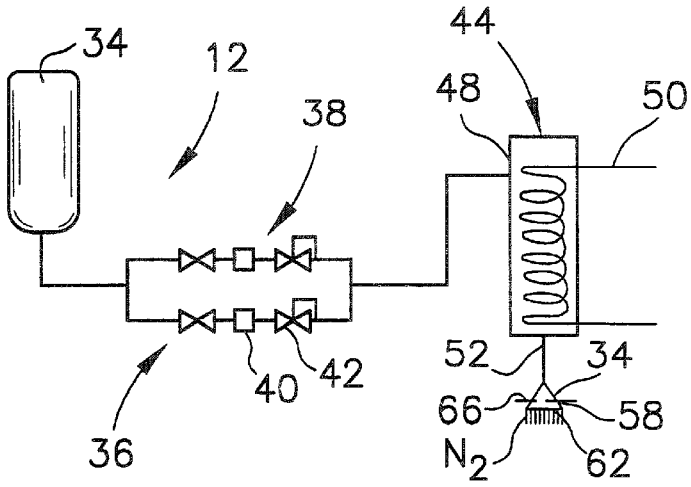
FIG. 2 is a schematic illustration of one embodiment of a head space inerting system embodying the principles of the present invention.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated. It should be further understood that the title of this section of this specification, namely, "Detailed Description Of The Invention", relates to a requirement of the United States Patent Office, and does not imply, nor should be inferred to limit the subject matter disclosed and claimed herein.

Referring now to the figures and in particular to FIG. 1, there is shown a convention form, fill and seal packaging machine 10 that includes a head space inerting system 12 embodying the principles of the present invention. The form, fill and seal packaging machine 10, absent the head space inerting system can be such as that disclosed in Katsumata, U.S. Pat. No. 6,012,267, which patent is assigned to the assignee of the present invention and is incorporated by reference herein. The machine is configured to store, erect, fill and seal a series of cartons moving therethrough.

A typical filling machine 10 includes a carton magazine 14 for storing the flat, folded carton blanks. The filling machine 10 includes a carton erection station 16 that receives the cartons in the flat, folded form, erects the cartons into a tubular form and seals the bottom flaps thereof. A fitment, such as the now widely recognized plastic spout, can then be applied to the partially erected carton.

The carton C can then be sterilized using, for example, vaporized hydrogen peroxide and/or ultraviolet radiation, and/or heat, at one or more sterilization stations 18. As will be recognized by those skilled in the art, sterilizing the cartons C reduces or eliminates the microbes such as bacteria, yeast and molds therein which increases the shelf life of the stored product. This is particularly true for liquid food products, such as milk, juice and the like. Exemplary sterilization systems are disclosed in Palaniappan et al., U.S. Pat. Nos. 6,120,730 and 6,056,918, which patents are assigned to the assignee of the present invention and are incorporated by reference herein.

The partially erected carton C, which at this point has the bottom flaps folded and sealed to form a sealed carton bottom and optionally a fitment applied thereto, is then conveyed to a top panel pre-folding station 20. At the top panel pre-folding station 20, the top panels P are folded or broken along preformed crease lines L which facilitate forming the well-recognized gable top shape. Breaking the carton C at the crease lines L provides for cleaner, crisper appearing folds at the top gable.

Subsequent to pre-folding, the partially erected carton C is filled with product at a filling station 22. As set forth above, this can be any one of a number of different types of product including, but not limited to, liquid food product, such as milk, juice or the like.

Following the filling operation, the top panels P, at about the top fins F, are heated. Heating the panels P tends to soften the polymeric coating on the packaging material for subsequent sealing. The carton C, having the top panels P sufficiently heated, is then conveyed into a top sealing station 24. At the top sealing station 24, the top panels P are folded toward one another and compressed at the top fin panels F, between, for example, a pressure plate and an anvil. The pressure developed between the pressure plate and the anvil in conjunction with the heated polymeric coating provides the top seal for the carton C. Subsequent to top sealing, the cartons C are conveyed out of the form, fill and seal packaging machine 10.

In a typical form, fill and seal packaging machine 10, the space or region, indicated generally at 26, from the sterilization station 18 to the top sealing station 24 is maintained as a sterile environment region. To this end, air is passed through an air sterilization system, indicated generally at 28, that can include a series of filters 30, such as high efficiency particulate adsorbing filters (HEPA filters), membrane filters, and the like, to remove particulates as well as microorganisms that may be in the air. The sterile environment within the region 26 of the machine 10 is maintained at a positive pressure relative to the outside environment. In this manner, any leakage is outward from the sterile machine environment 26, rather than into the machine environment 26 (i.e., out-leakage rather than in-leakage). This facilitates maintaining this environment in a sterile condition.

Nevertheless, the environment present within this sterile area 26 is an oxygen-rich environment. As will be recognized by those skilled in the art, even given today's sterilization techniques, some amount of microbes may remain in the carton or be present in the liquid food product. To this end, the oxygen-rich environment, even within the sterile environment 26 can promote microbial growth. In addition, as set forth above, it has been found that such an oxygen-rich environment can reduce the nutritional value of the product and reduce, degrade or react with the flavor of the food product.

In accordance with the present invention, the form, fill and seal packaging machine 10 includes head space inerting system 12 for replacing the air in the head space. The head space inerting system 12 replaces the oxygen that would otherwise be present within the sealed package above the level B of the product in the head space H in the package, with an inert gas. In a present inerting system 12, nitrogen $N_2$ is used to replace the oxygen in the head space H. It has been found that nitrogen, as an inerting agent, reduces the promotion of microbial growth and advantageously reduces flavor loss.

Although inerting systems that use nitrogen are known, such systems have their drawbacks. Typically, the entire environment within a sterile area is formed from a nitrogen atmosphere. While this may be effective, it is difficult to control and can be quite costly in that large quantities of nitrogen are needed to maintain necessary atmospheric conditions.

The present inerting system 12 uses a localized application or introduction of nitrogen $N_2$ directly into the carton head space H subsequent to filling. In a most preferred system, the nitrogen $N_2$ is heated prior to introduction into the head space H so that the elevated top fin F temperature (as a result of heating the top panels P at the fin portions F for carton C sealing) is not adversely effected. That is, the heated nitrogen $N_2$ does not significantly reduce the top fin F temperature below a temperature that would decrease the effectiveness of the top fin F seal. In a present system 12, the temperature of the top panel fins F remains at least about 110° C. (230° F.).

In a present embodiment, the nitrogen inerting system 12 includes a nitrogen source or supply 34, a valve assembly 36 and a filter regulator assembly 38. Nitrogen $N_2$ is supplied from the supply or source 34 and flows through the valve assembly 36 which regulates the flow of nitrogen $N_2$ from the supply 34 through the system 12. The regulated nitrogen $N_2$ is then filtered at a filter 40 and regulated (e.g., pressure controlled/reduced) at a regulator 42 to remove any particulates, oil or other contaminants and to establish a system 12 operating pressure. In a present embodiment, the system 12 operating pressure is about 1.5 psig, or at least about 1.0 psi greater than the sterile region 26 pressure, at a flow rate of about 50 liters per minute (1 pm), and at a temperature of about 250° C. (482° F.).

The filtered and regulated nitrogen $N_2$ is then heated in a nitrogen heater 44. Heating the nitrogen $N_2$ reduces the cooling effect that it might otherwise have on the carton top panel fins F as it flows past the fins F and into the carton head space H. It has been found that the heated nitrogen $N_2$ greatly enhances the ability of the top panel fins F to effectively create and maintain a top seal.

In a present embodiment, the nitrogen $N_2$ is heated in a coil-type electrical resistance heater or heat exchanger 44. An electrical coil 50 traverses through the heater 44. The nitrogen $N_2$ is directed through an inlet 48 into the heater 44. The heated nitrogen $N_2$ is then directed, through piping or the like (shown schematically at 52) to an introduction or nozzle assembly 54.

The nitrogen can be heated in a variety of types of heaters, such as steam heaters, or using other heat exchange media, which other heaters and exchange media will be recognized by those skilled in the art, and are within the scope and spirit of the present invention.

At the nozzle assembly 54, the nitrogen $N_2$ is introduced directly into the package head space H, immediately above the filled carton (product level B). The nitrogen $N_2$ is introduced following the top fin F heating and immediately prior to sealing. In this manner, the head space H environment is "replaced" with nitrogen to effectively eliminate the otherwise oxygen-rich environment above the product level B.

Figure 3:
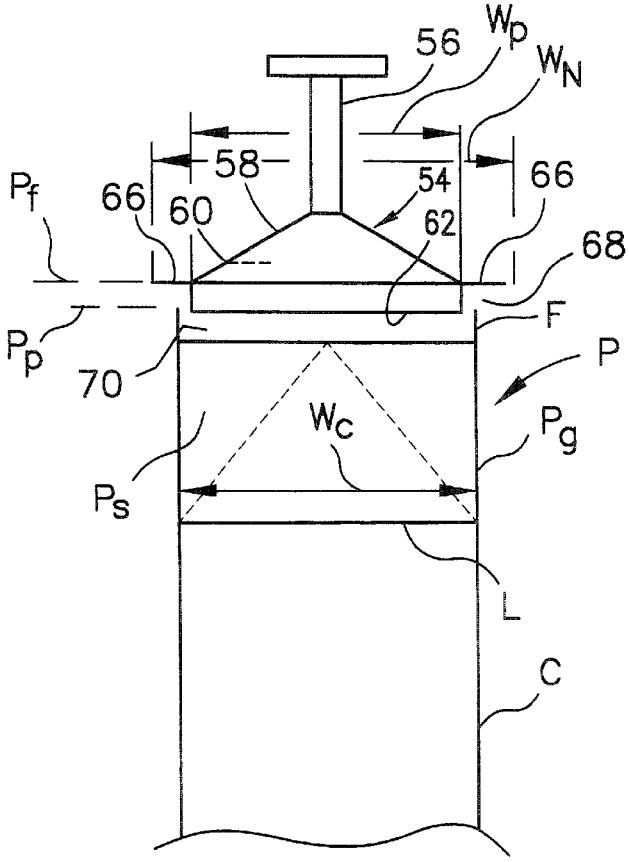
FIG. 3 is a bottom plan view of a dispersion plate for the nozzle, illustrating the nozzle flanges or fins extending therefrom.
Figure 5:
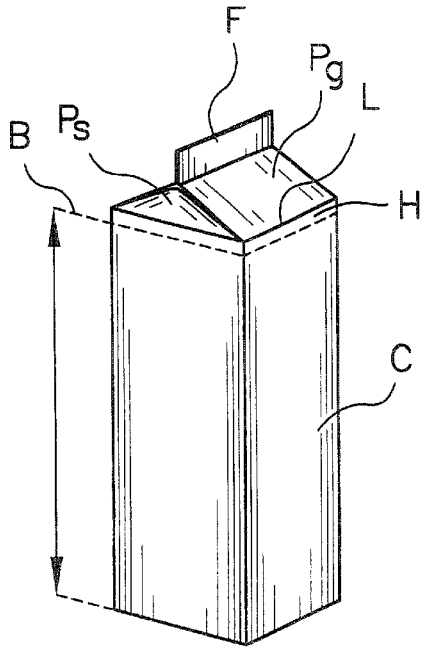
FIG. 5 is a simplified perspective view of a filled carton with the product level shown therein, in phantom, illustrating the head space portion of the filled carton.
Figure 4:
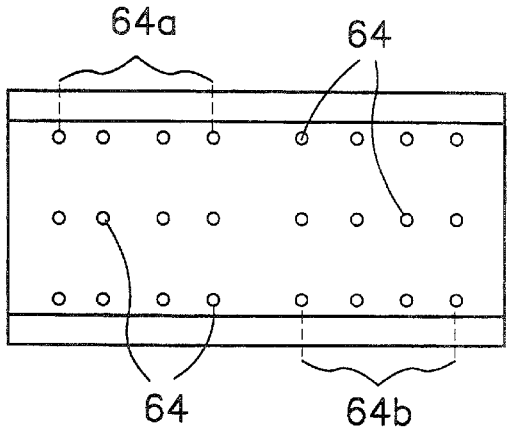
FIG. 4 is a schematic illustration of a nozzle positioned adjacent the container during the inerting operation.

One exemplary introduction or nozzle assembly 54 is illustrated in FIGS. 3–4. The nozzle 54 includes a inlet port 56 in flow communication with a plenum 58. The plenum 58 defines an open or flow space 60 from the inlet port 56 to a dispersion plate 62. The dispersion plate 62 is formed having a plurality of openings 64 therein (i.e., it is formed as a foraminous plate) for communicating the heated nitrogen $N_2$ in the flow space 60 to the carton head space H.

The nozzle assembly 54 includes flanges 66 that extend outwardly from the plenum 58, beyond the dispersion plate 62. The flanges 66 are positioned in a plane $p_f$ that is spaced from the plane $p_p$ of the dispersion plate 62, and serve as deflection plates. Referring to FIG. 3, there is shown a carton C having its top panels P open (prior to folding and sealing), as is the presentation following filling. The top/front and top/rear panels $P_g$, that is those panels that form the angled gable walls and the top fin F, extend upwardly, beyond their adjacent top/side panels $P_s$.

The plenum width $w_P$ is less than the carton width $w_C$, while the overall nozzle width $w_N$. (including the flanges 66) is greater than the carton width $w_C$. In this manner, the flanges 66 extend outwardly from the nozzle 54, over the front and rear panels $P_g$. The dispersion plate 62, when positioned over the carton C for introducing nitrogen $N_2$, is below the top of the fin panels F, while the flanges 66 are positioned above, and slightly spaced from the fin panels F. This establishes a gap, indicated at 68, between the top of the fin panels F and the flanges 66, and a gap, indicated at 70, between the top of the top/side panels $P_s$ and the dispersion plate 62.

It has been observed that these gaps 68, 70 provide a number of flow enhancing characteristics to the inerting system 12 arrangement. For example, during introduction of nitrogen $N_2$ into the container head space H, the air that otherwise resides within the head space H must be replaced or evacuated. These gaps 68, 70 provide sufficient flow space for the egress of air, without entraining or drawing air into the container as a result of, for example, a venturi effect, and without providing an excess of flow space that would otherwise allow the sterile air in the region 26 to enter or fill the carton C. It has also been found that the gaps 68, 70 prevent over pressurization of the containers C, again, without adversely effecting the introduction of nitrogen $N_2$ into the package.

In a current embodiment, the nozzle 54 has an elongated length so that head space H inerting can be carried out simultaneously on two packages (in a side-by-side processing arrangement). In order to conserve nitrogen $N_2$ use, the dispersion plate 62 has two distinct sets or regions of openings 64*a*, 64*b* that each correspond to the positioning of a carton C below that region for nitrogen introduction. In this manner, the package head space H can be filled with nitrogen $N_2$, without the extreme costs associated with maintaining a total nitrogen environment, while retaining the beneficial characteristics of effecting a positive pressure within the environmental or hygienic zone 26.

It has been found that heated nitrogen $N_2$ provides a number of advantages over nitrogen atmosphere systems. First, the cost for both the system 12 as well as the nitrogen supply to directly introduce nitrogen into the container head space H is considerably less than the cost for a nitrogen atmosphere system. Second, the presently used positive pressure supplied air system is retained, with little to no modification required. That is, sterilized air is still supplied to the environmentally controlled portions 26 of the form, fill and seal machine 10, while nitrogen $N_2$ is directly introduced into the container head space H.

In addition, it has been found that heating the nitrogen $N_2$ prior to introduction to the head space H eliminates problems that otherwise might be encountered as a result of cooled gas flowing over the heated top fin panels F. This provides greater assurance that the top fin F seal integrity is maintained and not compromised by the cooling effect that could otherwise be observed.

Although the present invention has been described and illustrated relative to a linear form, fill and seal packaging machine, those skilled in the art will recognize that other types of filling machines can include the present inerting gas system, which other types of machines are within the scope and spirit of the present invention.

In the present disclosure, the words "a"or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A head space inerting system for providing an inerting gas into the head space of a package formed on a form, fill and seal packaging machine for forming, filling and sealing packages, the machine having a filling station, a top heating station and a sealing station, the inerting system comprising:

an inerting gas source, for supplying the inerting gas;

an inerting gas heater, for heating the inerting gas;

an inerting gas nozzle assembly, the nozzle assembly including an inlet, a plenum defining a flow space and a dispersion plate, the nozzle assembly including flanges extending from opposing sides of the plenum and defining a plane, the dispersion plate defining a plane that is spaced from the plane defined by the flanges; and a flow conduit extending between the inerting gas source and the inerting gas heater and between the inerting gas heater and the inerting gas nozzle assembly, wherein the inerting gas nozzle assembly is disposed within the form, fill and seal packaging machine to introduce the inerting gas directly into the head space of the packages, the nozzle assembly being further disposed between the top heating station and the sealing station, and wherein the inerting gas nozzle assembly is configured for positioning between upstanding fin panels of the package, wherein the dispersion plate is disposed at least in part below an uppermost portion of the top fin panels, and wherein the flanges are disposed above the uppermost portion of the top fin panels.

2. The head space inerting system in accordance with claim 1 wherein the dispersion plate is formed as a wall of the plenum.

3. The head space inerting system in accordance with claim 1 wherein the dispersion plate is formed as a foraminous plate.

4. The head space inerting system in accordance with claim 1 including an inerting gas valve assembly and an inerting gas filter/regulator assembly, the valve assembly and filter/regulator assembly being disposed in the flow conduit between the inerting gas source and the inerting gas nozzle assembly.

5. The head space inerting system in accordance with claim 1 wherein the inerting gas heater is formed as a heat exchanger supplied by a heat source.

6. The head space inerting system in accordance with claim 5 wherein the heat source is an electrical resistance heating system.

7. The head space inerting system in accordance with claim 1 wherein the inerting gas is nitrogen.

* * * * *